United States Patent [19]

Hutchins

[11] 3,933,073

[45] Jan. 20, 1976

[54] MUSICAL INSTRUMENT CAPO

[76] Inventor: Marvin H. Hutchins, 10503 Ave. P, La Porte, Tex. 77571

[22] Filed: Apr. 24, 1975

[21] Appl. No.: 571,072

[52] U.S. Cl. ..... 84/318
[51] Int. Cl.[2] ..... G10D 3/08
[58] Field of Search ..... 84/318

[56] References Cited

UNITED STATES PATENTS

| | | | |
|---|---|---|---|
| 620,560 | 3/1899 | Averitt | 84/318 |
| 636,850 | 10/1899 | Ritter | 84/318 |
| 775,399 | 11/1904 | Halladay | 84/318 |

*Primary Examiner*—Lawrence R. Franklin

[57] ABSTRACT

This device consists primarily of an L-shaped configurated body having one leg hollow and in which is slidably received a spring loaded bar carrying a rubber sleeve thereon for automatically depressing the strings of a musical instrument, downward upon the neck of the instrument and the body of the device is padded with foam rubber so as to prevent marring the finish of the neck.

3 Claims, 6 Drawing Figures

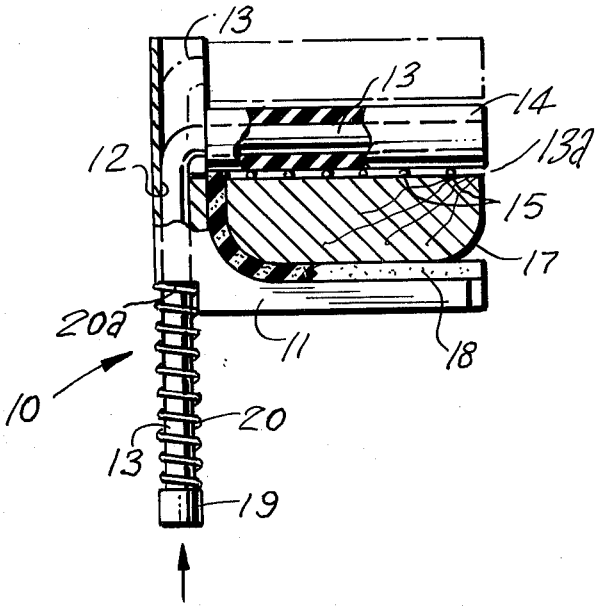
FIG. 1
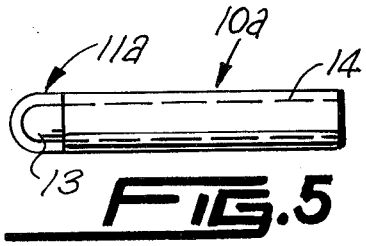
FIG. 5
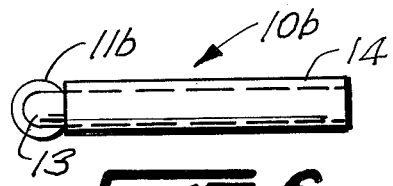
FIG. 6
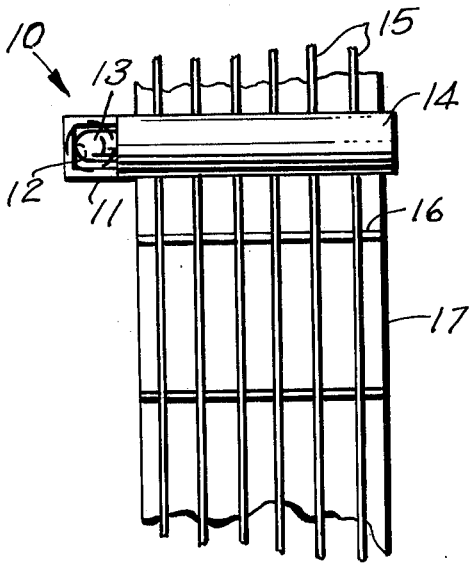
FIG. 2
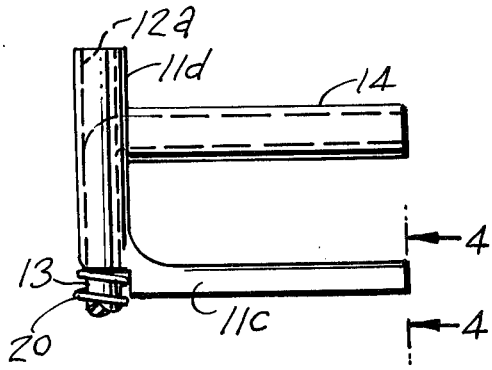
FIG. 3
FIG. 4
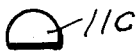

MUSICAL INSTRUMENT CAPO

This invention relates to devices for changing the key of instruments and more particular to a musical instrument capo.

It is therefore the principal object of this invention to provide a musical instrument capo which will be of such structure, so as to be operated with the index finger and thumb on only one hand.

Another object of this invention is to provide a capo of the type described, which will not be clumsy in use as are devices of the prior art.

A further object of this invention is to provide a capo of the type described, which will enable the musician to change keys easier and faster.

A still further object of this inveniton is to provide a capo of the type described which will have an L-shaped body which is padded and is hollow in one leg in which is received a slide bar that is spring loaded so as to urge the rubber sleeve portion downwards against the strings of the musical instrument in order to change the key thereof.

Other objects of the invention are to provide a musical instrument capo for which is simple in design, inexpensive to manufacture, rugged in construction, easy to use and efficient in operation.

These and other objects will be readily evident upon a study of the following specification and the accompanying drawing, wherein:

FIG. 1 is a side view of the present invention shown installed on the fret board of a guitar or other instrument, the device being shown partly broken away with the open position shown in phantom lines.

FIG. 2 is a top plan view of FIG. 1.

FIG. 3 is a fragmentary side view showing a modified form of the invention.

FIG. 4 is a view taken along the line 4—4 of FIG. 3.

FIG. 5 is a top plan view showing a modified form of the device.

FIG. 6 is similar to FIG. 5, but shows another modified form of the device.

According to this invention, a musical instrument capo 10 is shown to consist of an L-shaped configurated body made of suitable material, having an opening 12 through one side which slidably receives a slide bar 13 upon which is frictionally secured a rubber sleeve 14 for engagement with the strings 15 so as to urge them downwards against the fret bars 16 of the neck 17 of the instrument. The body 11 has adhered in a suitable manner, to it, foam rubber padding 18 for preventing damage to the finish of the neck 17. A retaining cap 19 is secured fixedly to one slide bar 13 and urges against one end of spring 20. The opposite end of spring 20 springingly urges against a step 20A in body 11.

In use, the musician puts his index finger of the left hand on the top of the body 11 and his thumb of the same hand, under the retainer cap 19. Then the musician squeezes his finger and thumb together which compresses the tension spring 20 which raises the slide bar 13 so as to define an opening 13A. The musician then slips the capo 10 onto the instrument neck 17 at the desired fret and then he releases the spring 20 tension and the capo 10 remains in fixed position upon the neck 17 of the instrument.

Referring now to FIGS. 5 and 6 of the drawing, it will be seen that a modified form of capo 10A is shown to have a rounded leg 11A in which the slide bar 13 is slidable. Looking now at the modified form 10B, a formed leg 11B is shown to receive the slide bar 13.

Referring now to FIG. 3 and 4 of the drawing, a leg 11D is circular in configuration and receives slide bar 13.

It will be noted that the leg 11C is semicircular in configuration.

What I claim is:

1. A musical instrument capo for changing the key stringed instruments, comprising, an L-shaped body, an L-shaped slide bar slidably carried within said body with cap means and spring means for operating, a rubber sleeve carried upon said slide bar and protective padding secured to said capo for protecting the neck of the instrument.

2. The combination according to claim 1, wherein one leg of said L-shaped body of said capo is hollow and slidably receives said slide bar, said body of said capo having step means in the outer peripheral apex corner, said slide bar having spring means thereon, said spring urging against said step at one end and urging against a retaining cap at the opposite end.

3. The combination according to claim 2, wherein the opposite leg of said slide bar frictionally engages the interior peripheral surface of a rubber sleeve, said rubber sleeve urging against the strings of said instrument when said capo was in place upon the neck of said instrument and the interior peripheral area of said body of said device is secured fixedly to foam rubber padding which abuts with said neck of said musical instrument.

* * * * *